United States Patent [19]

Johnson et al.

[11] Patent Number: 4,869,677

[45] **Date of Patent: * Sep. 26, 1989**

[54] BACKPLANE CONNECTOR

[75] Inventors: Lennart B. Johnson, Milford; William B. Walkup; Steven F. Laychak, both of Amherst, all of N.H.

[73] Assignee: Teradyne, Inc., Boston, Mass.

[ * ] Notice: The portion of the term of this patent subsequent to Apr. 7, 2006 has been disclaimed.

[21] Appl. No.: 201,082

[22] Filed: Jun. 1, 1988

Related U.S. Application Data

[60] Division of Ser. No. 31,242, Mar. 26, 1987, which is a division of Ser. No. 828,160, Feb. 10, 1986, Pat. No. 4,655,518, which is a continuation of Ser. No. 641,915, Aug. 17, 1984, abandoned.

[51] Int. Cl.[4] ..... H01R 4/66; H01R 9/09

[52] U.S. Cl. ..... 439/80; 439/108

[58] Field of Search ..... 439/59–62, 439/64, 101, 108, 607–610, 629, 79, 80

[56] References Cited

U.S. PATENT DOCUMENTS

| | | |
|---|---|---|
| 3,391,381 | 7/1968 | Livingston . |
| 3,399,372 | 8/1968 | Uberbacher . |
| 3,432,795 | 3/1969 | Jayne . |
| 3,530,422 | 9/1970 | Goodman . |
| 3,922,056 | 11/1975 | Murawski et al. . |
| 4,042,289 | 8/1977 | Heinonen et al. . |
| 4,134,632 | 1/1979 | Lindberg et al. . |
| 4,392,705 | 7/1983 | Andrews, Jr. et al. . |
| 4,428,640 | 1/1984 | Pittman . |
| 4,451,107 | 5/1984 | Dola et al. . |
| 4,457,575 | 7/1984 | Davis et al. . |
| 4,486,059 | 12/1984 | Deyoung . |
| 4,494,818 | 1/1985 | Petersen et al. . |
| 4,512,618 | 4/1985 | Kumar . |
| 4,521,062 | 6/1985 | Kurbikoff et al. . |

FOREIGN PATENT DOCUMENTS 2517482 6/1983 France .

OTHER PUBLICATIONS

Teradyne Information Sheets, KE II Printed Circuit Cardedge Backplanes.

Teradyne Information Sheets, Minimax Backplane Interconnection Systems, 1978.

Teradyne Information Sheets, Minimax/LSI Inverse DIN Backplane System, 1981.

Teradyne Information Sheet, Inverse DIN Daughter Board Stiffener, 1983.

*Primary Examiner*—Neil Abrams

[57] ABSTRACT

A backplane/daughter board connector including a first connector element and a mating second connector element that fits between upwardly extending sidewalls of the first element, the first element being provided with an additional contact carried by one of its sidewalls, and the mating connector element being provided with a further contact carried by a facing outside wall, the sidewall contacts providing a short ground path.

17 Claims, 2 Drawing Sheets

BACKPLANE CONNECTOR

This application is a division of application Ser. No. 031,242, filed Mar. 26, 1987, of Lennart B. Johnson et al. for "BACKPLANE CONNECTOR", which is a division of application Ser. No. 828,160, filed Feb. 10, 1986, of Lennart B. Johnson for "BACKPLANE CONNECTOR", now U.S. Pat. No. 4,655,518, which is a continuation of application Ser. No. 641,915, filed Aug. 17, 1984, now abandoned.

FIELD OF THE INVENTION

The invention relates to a connector for connecting a daughter printed circuit board (PCB) to a backplane.

BACKGROUND OF THE INVENTION

Backplanes are printed circuit boards or metal plates on the upper sides of which "daughter" PCB's are detachably mounted perpendicularly to the backplanes for easy removal. One way of electrically connecting a daughter board to another daughter board, the backplane, and other circuitry is by a two-piece multiple-contact connector consisting of a first connector element that is attached to the backplane and a mating second connector element that is attached to the daughter board and fits between upwardly extending sidewalls of the first element. When the two elements are joined, a plurality of rows of contact posts directed upwardly between the sidewalls of the first element are connected to a plurality of corresponding downwardly directed forked contacts of the second element.

SUMMARY OF THE INVENTION

We have discovered that by providing a backplane/-daughter board connector with an additional contact carried by a sidewall of one of the two connector elements and a further contact carried by a facing outside wall of the other connector element an additional connection for distributing current, e.g., for ground or power, can be advantageously provided without increasing the overall size of the connector.

In preferred embodiments, there are grooves in the sidewall of the connector element toward the backplane and a plurality of resilient contact portions extending from the grooves; the contact portions have laterally extending tabs at their upper movable ends to prevent the contact portions from extending too far into the region between the sidewalls to prevent jamming; there are further recesses in the sidewall near the tops of the grooves to receive the movable ends of the contact portions when they are deflected; a single contact in the connector element toward the backplane has a plurality of contact portions located in the grooves; and the contacts on the other connector element are large enough to contact a plurality of contact portions of a contact of the first connector element.

DESCRIPTION OF THE PREFERRED EMBODIMENT

The structure and operation of the presently preferred embodiment of the invention will now be described after first briefly describing the drawings.

STRUCTURE

Figure 1:
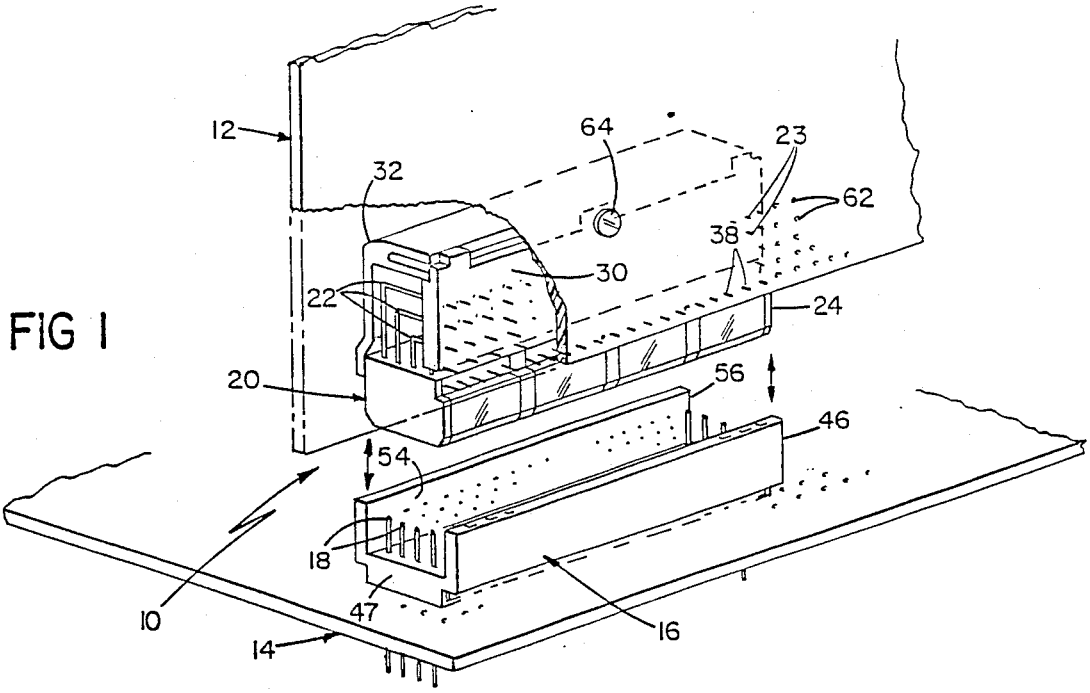
FIG. 1 is a perspective view of a connector for connecting a daughter printed circuit board to a backplane according to the invention.

Referring to FIG. 1, there is shown two-piece connector 10 for electrically connecting daughter printed circuit board 12 (shown diagrammatically without any electronic components) to backplane 14. Connector 10 includes lower backplane connector element 16 connected to backplane 14 and upper daughter board connector element 20 connected to daughter board 12. Secured to backplane 14 and passing upwardly through backplane connector element 16 are four rows of signal contact pins 18 for mating with a corresponding plurality of forked signal contacts 22 mounted in housing 24 (FIG. 2).

Figure 2:
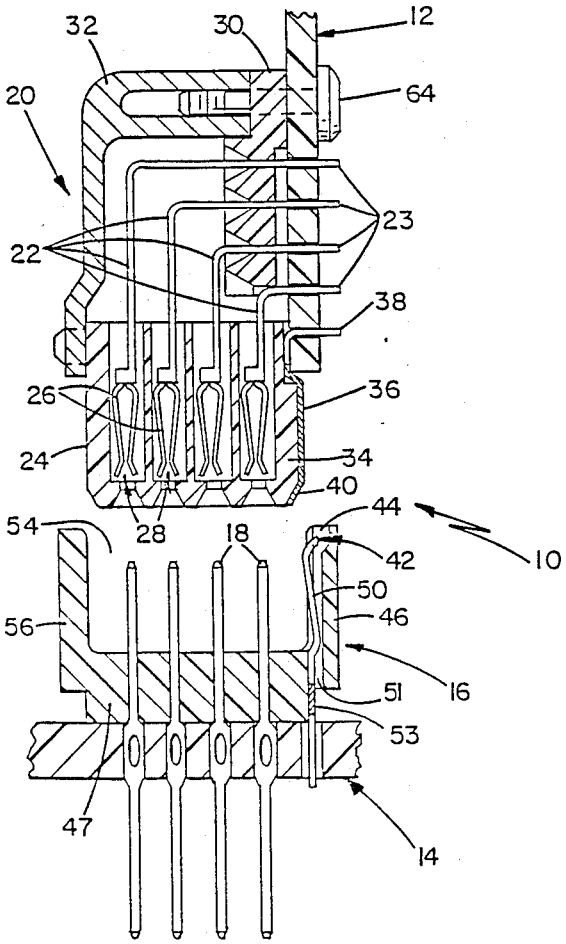
FIG. 2 is a vertical sectional view, taken at 2—2 of FIG. 1, of the FIG. 1 connector.
Figure 5:
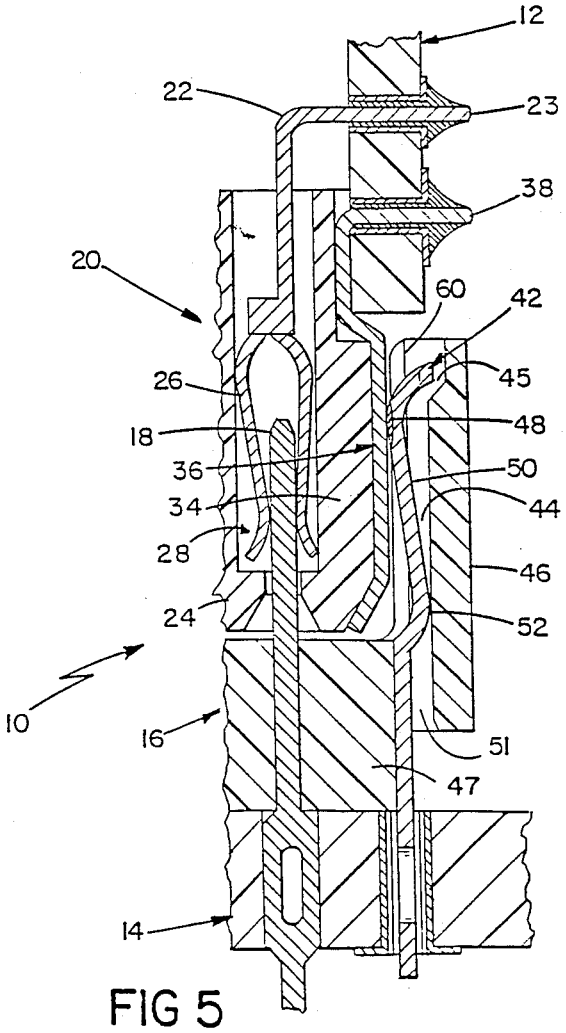
FIG. 5 is a vertical sectional view, taken at 5—5 of FIG. 1, showing mating of contacts of the FIG. 1 connector in use.
Figure 3:
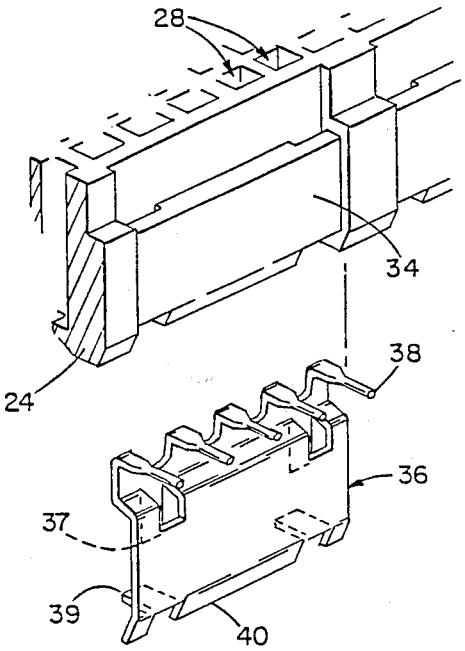
FIG. 3 is an exploded diagrammatic perspective view showing a contact of a daughter board connector element of the FIG. 1 connector and the portion of the daughter board connector element on which the contact is carried.

Referring to FIGS. 2, 3 and 5, signal contacts 22 of daughter board connector element 20 are forked at lower ends 26 in boxes 28 of plastic housing 24 and extend upwardly and are bent horizontally. The other ends 23 of contacts 22 pass through plastic guide board 30 and holes in daughter board 12, where they are soldered (FIG. 5). Aluminum stiffener 32 is connected between guide board 30 and housing 24 to cover exposed portions of contacts 22 and provide structure to daughter board connector element 20. On an outer face of side wall 34 of housing 24 are ground contacts 36, shown isolated from housing 24 and in more detail in FIG. 3. Contacts 36 are secured to wall 34 of housing 24 via vertical tabs 37, secured in place during molding of housing 24, and horizontal tabs 39, bent upward after molding. The lower ends of contacts 36 are inclined to provide guide surfaces 40. Laternally extending prongs 38 of contacts 36 pass through holes in daughter board 12, where they are soldered (FIG. 5). Contacts 36 are approximately 0.008 inch thick and are made of phosphor bronze with 100 microinches of nickel covered by 20 microinches of plated gold.

Figure 4:
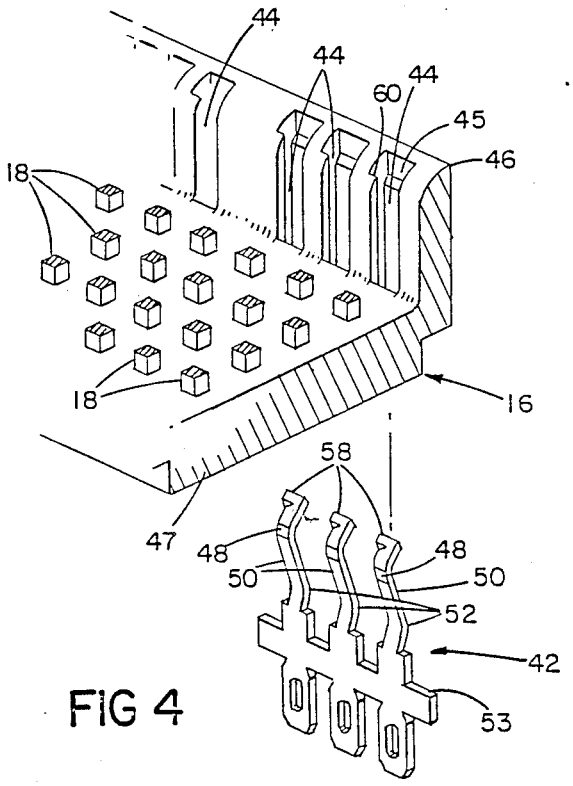
FIG. 4 is an exploded perspective view showing a contact of a backplane connector element of the FIG. 1 connector prior to placement in grooves of sidewalls of a backplane connector element of the FIG. 1 connector.

Referring to FIGS. 2, 4 and 5, it is seen that signal contact pins 18 of backplane connector element 16 are press fit in backplane 14, and that backplane connector element 16 has sidewall contacts 42 provided in grooves 44 of right-hand sidewall 46 extending upward from base 47. Each contact 42 has three contact portions 50 that extend upward from connecting portion 53 through holes 51 to grooves 44. Adjacent to the top of base 47, contact portions 50 bend away from contact region or cavity 54 between sidewalls 46, 56 to fulcrum portion 52. From there they bend back toward and into contact region 54, and at contact points 48 they begin to bend back away from region 54. At the upper movable end of each contact portion 50 is tab 58, which extends laterally behind overhanging portion 60 of sidewall 46. Recess 45 extends further into sidewall 46 at the top of groove 44. Contacts 42 are made of a copper alloy (C72500) and have a welded inlay at contact areas 48 (FIG. 4) of 100 microinches of nickel covered by 100 microinches of gold.

OPERATION

In use, backplane connector element 16 is connected to backplane 14 by inserting the lower press-fit portions of contact pins 18 and contacts 42 through holes in the backplane. Daughter board connector element 20 is connected to daughter board 12 by screw 64 through guide board 30 and stiffener 32 and also by solder where ends 23 of contacts 22 and prongs 38 of contacts 36 pass through holes 62 in daughter board 12. Contacts 18, 22 are used to carry signals, while contacts 36, 42 are used to carry ground.

Before insertion of daughter board connector element 20 into contact region 54, tabs 58 bear against overhanging portions 60, owing to preloading forces, and precisely locate the contact points 48 so that they do not extend into contact region 54 so far that there would be jamming during insertion. When daughter board connector element 20 is inserted into contact region 54, contact pins 18 are received between forked prongs 26; the upper ends of contacts 42 are bent back slightly by inclined surface 39 and received in recesses 45, and contacts 36 touch contact points 48 of contacts 42, as is shown in FIG. 5. Recesses 45 are provided so that contact portions 50 are only bent at the lower ends to prevent the very large insertion forces that would be required if contact portions 50 were supported at two ends.

In addition to providing ground connections without taking up any extra space on connector 10, a further advantage is that ground contact prongs 38 can be provided on daughter boards 12 immediately adjacent to a row of signal contacts 22 to provide a short ground path to permit high-speed switching.

OTHER EMBODIMENTS

Other embodiments of the invention are within the scope of the following claims.

What is claimed is:

1. A daughter printed circuit board and backplane assembly comprising a backplane, a plurality of daughter printed circuit boards mounted perpendicular to said backplane, a plurality of first connector elements connected to either said backplane or said daughter boards, each said first connector element including a base of insulating material, a pair of first elongated flat sidewalls of insulating material extending from said base perpendicular to said base and parallel to the daughter boards and to each other and spaced from each other to define a contact region between their inwardly directed faces, and a plurality of rows of free standing first contacts extending from said base parallel to said sidewalls along first axes between and parallel to said first sidewalls and said base, a plurality of second connector elements connected to the other of said backplane or daughter boards, each said second connector element including a housing of insulating material having outwardly directed second sidewalls facing and fitted between said first sidewalls and a plurality of second contacts therein arranged in rows parallel to said first and second sidewalls along second axes between and parallel to said first and second sidewalls and aligned with and contacting said first contacts of a respective first connector element, one of said first and second contacts being male contacts, the other of said first and second contacts each being female contacts having two opposing contact portions for receiving one of said male contacts between said portions, a plurality of third contacts being carried by a said first sidewall and having inwardly directed third contact portions, a plurality of fourth contacts carried by a said second sidewall and having outwardly directed fourth contact portions contacting said third contact portions, a plurality of fifth contacts, said fifth contacts being integral with said second contacts, said second and fifth contacts being opposite extremities of a single contact member, and a plurality of sixth contacts, each of said sixth contacts being integral with at least one of said fourth contacts, said fourth and sixth contacts being opposite extremities of a single contact member.

2. The assembly of claim 1 wherein said contact region is free of insulating material of said first connector element.

3. The assembly of claim 1 wherein said fifth contacts are related to said sixth contacts to form rows therewith.

4. The assembly of claim 1 wherein said third contacts are related to said first contacts to form rows therewith.

5. The assembly of claim 1 wherein each said fourth contact has a planar contact surface with a width along said second sidewall so as to overlap a plurality of said second contacts in other said rows in said second connector element, said fourth contact overlapping a plurality of said second contacts in the same said row along a said second axis.

6. The connector of claim 5 wherein a plurality of third contacts are integral with each other and include portions between adjacent third contacts joining them together.

7. The assembly of claim 1 wherein said third contacts and fourth contacts extend beyond said first and second contacts so as to provide electrical connection between said third and fourth contacts prior to connection between said first and second contacts during insertion of a said second connector element into a said first connector element.

8. The assembly of claim 1 wherein said first sidewall carrying said third contacts has grooves in it and openings to said grooves in its inwardly directed face, said plurality of third contacts have portions that are in said grooves and exposed to said contact region, and said third contact portions are resilient.

9. The assembly of claim 1 wherein said third contact portions extend into said contact region, said sidewalls have overhanging portions adjacent to said openings in said inwardly directed face such that said openings are smaller in width than the grooves behind said overhanging portions, and said third contact portions have movable ends that are bent away from said contact region and have laterally extending tabs that interact with said overhanging portions to prevent said third contact portions from extending into said contact region too far, to prevent jamming.

10. The assembly of claim 9 wherein extending further into said sidewall from said grooves are recesses for receiving said movable ends when said contact portions are biased into said grooves.

11. The assembly of claim 8 wherein said grooves communicated with holes through said base, and said third contacts pass through said holes.

12. The assembly of claim 11 wherein a plurality of third contacts are integral with each other and include portions between adjacent third contacts joining them together under said holes.

13. The assembly of claim 12 wherein said third contact portions extend into said contact region between said inwardly directed faces, said sidewalls have overhanging portions adjacent to said openings in said inwardly directed face such that said openings are smaller in width than the grooves behind said overhanging portions, and said third contact portions have movable ends that are bent away from said contact region and have laterally extending tabs that interact with said overhanging portions to prevent said contact portion from extending into said contact region too far, to prevent jamming.

14. The assembly of claim 12 wherein each said third contact has a fulcrum portion above its corresponding said hole, said contact portion bending away from said contact region between said sidewalls and back toward said contact region at said fulcrum portion.

15. The assembly of claim 3 wherein each said fourth contact has tabs securing said contact to said second sidewall of said second connector element.

16. The assembly of claim 5 wherein each said fourth contact portion is adapted to contact a plurality of said third contact portions and has a lower portion that is inclined to bias said third contact portions away from said region during insertion.

17. The assembly of claim 1 wherein said first connector elements are attached to said backplane, and said first and third contacts are press-fit into said backplane.

* * * * *

UNITED STATES PATENT AND TRADEMARK OFFICE

CERTIFICATE OF CORRECTION

PATENT NO. : 4,869,677

DATED : September 26, 1989

INVENTOR(S) : Lennart B. Johnson, William B. Walkup, Steven F. Laychak

It is certified that error appears in the above-identified patent and that said Letters Patent is hereby corrected as shown below:

Column 4, line 56, "1" should be --8--.

Signed and Sealed this

Fifth Day of February, 1991

*Attest:*

HARRY F. MANBECK, JR.

*Attesting Officer*

*Commissioner of Patents and Trademarks*